US009951743B2

(12) United States Patent
Idicheria et al.

(10) Patent No.: US 9,951,743 B2
(45) Date of Patent: Apr. 24, 2018

(54) PLASMA IGNITION DEVICE

(71) Applicant: GM GLOBAL TECHNOLOGY OPERATIONS LLC, Detroit, MI (US)

(72) Inventors: Cherian A. Idicheria, Novi, MI (US); Paul M. Najt, Bloomfield Hills, MI (US); Laxminarayan L. Raja, Austin, TX (US)

(73) Assignee: GM Global Technology Operations LLC, Detroit, MI (US)

( * ) Notice: Subject to any disclaimer, the term of this patent is extended or adjusted under 35 U.S.C. 154(b) by 165 days.

(21) Appl. No.: 15/103,511

(22) PCT Filed: Feb. 24, 2015

(86) PCT No.: PCT/US2015/017254

§ 371 (c)(1),
(2) Date: Jun. 10, 2016

(87) PCT Pub. No.: WO2015/130655

PCT Pub. Date: Sep. 3, 2015

(65) Prior Publication Data

US 2016/0305393 A1 Oct. 20, 2016

Related U.S. Application Data

(60) Provisional application No. 61/944,786, filed on Feb. 26, 2014.

(51) Int. Cl.
*F02P 13/00* (2006.01)
*F02P 9/00* (2006.01)
(Continued)

(52) U.S. Cl.
CPC ..... *F02P 9/007* (2013.01); *H01T 13/20* (2013.01); *H01T 13/50* (2013.01); *F02P 13/00* (2013.01); *F02P 15/10* (2013.01)

(58) Field of Classification Search
CPC F02P 9/007; F02P 13/00; H01T 13/20; H01T 13/50
See application file for complete search history.

(56) References Cited

U.S. PATENT DOCUMENTS

2005/0040749 A1* 2/2005 Lindsay ..... H01T 13/467 313/143
2009/0223474 A1* 9/2009 Ehrlich ..... H01T 13/50 123/143 B
2012/0007488 A1* 1/2012 Kameda ..... H01T 13/20 313/141

FOREIGN PATENT DOCUMENTS

CN 102536589 A 7/2012
CN 202651617 U 1/2013
(Continued)

OTHER PUBLICATIONS

"Fundamental Analysis of Combustion Initiation Characteristics of Low Temperature Plasma Ignition for Internal ambustion Gasoline Engine", Shiraishi, Taisuke; Urushihara, Tomonori, SAE International, Apr. 12, 2011.

*Primary Examiner* — Kevin A Lathers
(74) *Attorney, Agent, or Firm* — Quinn IP Law

(57) ABSTRACT

An igniter includes a central electrode terminating in a firing portion including a plurality of prong tiers distributed axially on the firing portion. Each prong tier including at least one firing prong extending radially outward from the firing portion. The igniter body includes a port end to be received into an engine igniter port, and a shank. The firing portion of the central electrode extends from the shank opposing the port end. A dielectric casing can fully encapsulate the firing portion of the central electrode to define a dielectric barrier adjacent the firing prong. The igniter may include a generally cylindrical ground electrode defining a discharge cavity surrounding the central electrode. The ground electrode
(Continued)

includes a plurality of ground prongs defined by the ground electrode and extending radially toward the firing portion. A plurality of apertures defined by the ground electrode are in fluid communication with the discharge cavity.

20 Claims, 3 Drawing Sheets

(51) Int. Cl.

| | |
|---|---|
| ***H01T 13/20*** | (2006.01) |
| ***H01T 13/50*** | (2006.01) |
| *F02P 15/10* | (2006.01) |

(56) References Cited

FOREIGN PATENT DOCUMENTS

| | | | | |
|---|---|---|---|---|
| EP | 0913897 | A1 | | 5/1999 |
| KR | 20010002379 | A | | 1/2001 |
| KR | 100300913 | B1 | * | 11/2001 |

* cited by examiner

PLASMA IGNITION DEVICE

CROSS-REFERENCE TO RELATED APPLICATION

This application claims the benefit of International Patent Application PCT/US2015/017254 filed Feb. 24, 2015 and U.S. Provisional Application 61/944,786, filed Feb. 26, 2014, which are hereby incorporated by reference in its entirety.

TECHNICAL FIELD

This disclosure relates to a low-temperature plasma ignition device for use in an internal combustion system.

BACKGROUND

An ignition system in a combustion chamber of an engine includes an igniter for igniting a combustible air-fuel mixture in the chamber. The igniter may use a non-thermal corona discharge generated by the application of high voltage to an electrode such that current flows from sharp corners or projecting points of the electrode to ionize the air in the chamber to create a region of plasma around the electrode providing a plasma discharge streamer to ignite the air-fuel mixture. The plasma discharge streamer is restricted to a small area. Plasma (corona) discharge exhibits a propensity for arcing, such that voltage and/or duration of the ignition event must be closely controlled to minimize or prevent arcing.

Barrier discharge igniters do not exhibit arcing due to a non-conducting coating which prevents transition of the plasma discharge into an arc. The ignition provided by a barrier discharge igniter is provided by the electrical discharge between two electrodes separated by a dielectric barrier such that the ignition is confined to a small volume defined by the gap between the electrodes. Such a system is described by t. Shiraishi et al. in SAE Technical Paper 2011-01-0660 entitled *Fundamental Analysis of Combustion Initiation Characteristics of Low Temperature Plasma Ignition for Internal Combustion Gasoline Engine*, published Apr. 12, 2011, doi: 10.4271/2011-01-0660.

SUMMARY

A low-temperature plasma ignition device for igniting a combustible air-fuel mixture in a combustion chamber of an engine is provided. The plasma ignition device, also referred to herein as an igniter, includes a central electrode having a firing portion including tiered firing prongs distributed axially along the firing portion of the central electrode. In an installed position in an engine, the firing portion of the central electrode extends into a combustion chamber of the engine. Each tier of firing prongs includes at least one firing prong extending radially from the central electrode and terminating at a firing tip. A high frequency/high voltage pulse is applied to the central electrode such that an electric field forms at each firing prong and is concentrated at the firing tip of the respective firing prong. The electric field ionizes the combustible mixture and provides a plasma discharge igniting the combustible mixture. The plasma discharge may be in the form of a non-equilibrium (cold) plasma discharge streamer, also referred to herein as a discharge streamer, or as a streamer, which originates from the prong tip of the firing prong. The plurality of firing prongs generates multiple streamers to ignite a larger volume of the combustible mixture. The firing prongs are arranged in tiers and are spaced axially and radially relative to the firing portion.

In one configuration, the firing portion is fully encapsulated by a dielectric casing which provides a dielectric barrier around the firing portion of the central electrode including the tiered firing prongs. The casing is configured such that the dielectric barrier is of variable thickness, and is thinnest at the prong tip of each firing prong. In this configuration, a plasma discharge streamer originates from the dielectric casing surface that is closest to the tip of each prong. The discharge streamers formed in this manner are self-limiting and prevent the streamer from turning into an arc due to charge-trapping behavior of the dielectric surface, that with an applied voltage present, discharge streamers are continuously formed from the tip of each firing prong and self-extinguish prior to arcing.

The igniter may include a ground electrode surrounding the firing portion of the central electrode to define a discharge cavity. The ground electrode defines a plurality of ground prongs extending radially toward the central electrode and distributed in an arrangement corresponding to the arrangement of the plurality of firing prongs of the central electrode such that a streamer pattern is generated which is distributed axially and radially relative to the firing portion. The ground electrode may be generally cylindrical in shape and coaxial with the central electrode. The ground electrode may include a plurality of apertures to provide flow of the combustible mixture from the combustion chamber into a discharge cavity. The apertures may operate as flame ports to extend ignition to the combustible mixture in the combustion chamber adjacent the igniter.

The above features and advantages and other features and advantages of the present disclosure are readily apparent from the following detailed description of the best modes for carrying out the invention when taken in connection with the accompanying drawings.

DETAILED DESCRIPTION

Figure 1:
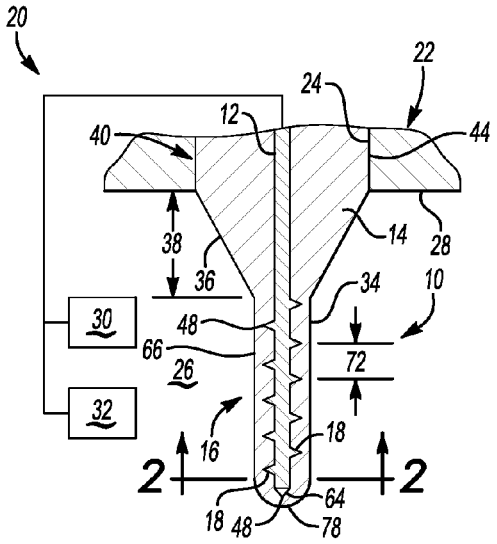
FIG. 1 is a schematic cross-sectional view of a first example configuration of a plasma igniter.

A low-temperature plasma igniter 10 for igniting a combustible air-fuel mixture is provided. The igniter 10 may be configured for use in a combustion chamber 26 of an internal combustion engine 20, which may be a gasoline engine or alternate fuel engine. Due to low current and low heat discharge, the plasma ignition device 10 described herein may have minimal to no electrical erosion as compared, for example, with a conventional spark plug which generates a single short electrical arc between a power electrode and a ground electrode and requires higher current applied to prolong the arc duration to provide ignition energy to ignite the air-fuel mixture in the combustion chamber.

Referring to the figures, like numerals indicate like parts throughout the several views. The elements shown in FIGS. 1-15 are not necessarily to scale or proportion. Accordingly, the particular dimensions and applications provided in the drawings presented herein are not to be considered limiting. Those having ordinary skill in the art will recognize that terms such as "above," "below," "upward," "downward," "top," "bottom," etc., are used descriptively for the figures, and do not represent limitations on the scope of the invention, as defined by the appended claims.

Referring to FIG. 1, a plasma ignition device is generally indicated at 10, and may be referred to herein as a plasma igniter or as an igniter. The igniter 10 provided herein includes a central electrode 12 having a firing portion 16 configured to extend into a combustion chamber 26 of an engine 20, the firing portion 16 having multiple tiers 70 of firing prongs 18 to originate multiple streamers of plasma discharge (not shown), thereby increasing the effective volume of plasma discharge in a combustion chamber 26 and/or ignition chamber 62 and increasing the initial flame development and subsequent fuel burn rate during a combustion event, providing advantages in increased fuel economy, due to fuel ignition and burn efficiencies, adaptability for use in lean combustion systems, and relatively lower emission of emission gases such as nitrogen oxide (NOx) carbon monoxide (CO), and hydrocarbon (HC) gases.

Figure 3:
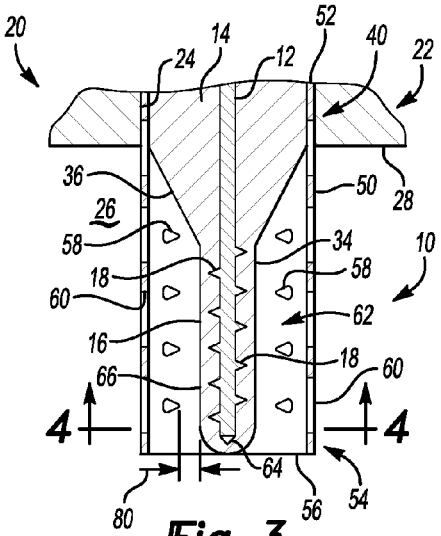
FIG. 3 is a schematic cross-sectional view of a second example configuration of a plasma igniter including a ground electrode.

The igniter 10 is configured for use in a combustion chamber generally indicated at 26 and at least partially defined by a combustion chamber surface 28. The combustion chamber 26 may be a combustion chamber of an internal combustion engine generally indicated at 20 in FIG. 1. In an illustrative example, the igniter 10 includes a power electrode 12, also referred to herein as a central electrode, which can be electrically actuated by a high frequency/high voltage pulse to generate a plasma discharge which form discharge streamers (not shown) to provide ignition energy to ignite an air-fuel mixture (not shown) in the combustion chamber 26. The engine 20 includes an engine portion generally indicated at 22, which may be a cylinder head 22. The engine portion 22 defines the combustion chamber surface 28 and includes an igniter port 24 for receiving the igniter 10 in an installed position. The combustion chamber surface 28 is adjacent the igniter 10 with the igniter 10 in the installed position. In one example, the igniter port 24 may be configured as a standard spark plug port of an engine 20. As shown in FIGS. 1 and 3, in the installed position, a port end 52 of an igniter body 40 is retained in the igniter port 24 and the remainder of the igniter 10, including a shank portion 36 of the igniter body 40 and a firing portion 16 of the power electrode 12, extends from the combustion chamber surface 28 and into the combustion chamber 26. In the installed position the shank portion 36 of the igniter body 40 is intermediate the firing portion 16 and the combustion chamber surface 28. The firing portion 16 may be positioned in the combustion chamber 26 proximate a fuel injector (not shown) and one or more pistons (not shown).

The internal combustion engine 20 may be included in a vehicle (not shown) which may be any type and/or style of vehicle including but not limited to a automobile, truck, utility vehicle, recreational vehicle, watercraft, aircraft, etc. The internal combustion engine 20 may be used in a non-vehicle application, for example, in a power generating application such as a generator, etc. The internal combustion engine 20 may be fueled by any type of combustion fuel requiring ignition, such as, for example, gasoline, ethanol, methanol, compressed natural gas (CNG), or other alternate fuels of the type used in an internal combustion engine 20. A controller 30 and a power source 32 are shown in FIG. 1, in operative communication with the igniter 10. The controller 30 and/or the power source 32 may be in operative communication with other components in the combustion system of the engine 20. For example, the controller 30 can be in operative communication with a fuel injector (not shown) positioned in the combustion chamber 26, and configured to command the fuel injector to provide a supply of combustible fuel to the combustion chamber 26 to mix with air and/or other gases including recirculated engine 20 gases (EGR) present in the combustion chamber 26, to provide a combustible air-fuel mixture in the combustion chamber 26 and proximate the igniter 10 at the time the igniter 10 is actuated. The controller 30 may be configured to coordinate actuation of the fuel injector and actuation of the igniter 10 to control the timing of introduction of fuel into the chamber by the fuel injector with timing of actuation of the igniter 10 to ignite the air-fuel mixture in the combustion chamber 26. The controller 30 can command the power source 32 to provide an electrical current to the igniter 10 to actuate the igniter 10 as further described herein to ignite the air-fuel mixture in the combustion chamber 26.

As shown in FIG. 1, the power electrode 12 of the igniter 10 extends axially through the body 40 of the igniter 10, and terminates in a firing portion 16 which extends beyond the shank 36 of the igniter body 40. In the example shown in FIG. 1, the firing portion 16 is fully encapsulated in a casing 34 made of a dielectric material 14. The power electrode 12 is electrically connected to the power source 32 at the port end 52 of the igniter 10, and is actuated by a high frequency voltage provided to the power electrode 12 from the power source 32 and controlled by the controller 30. The port end 52 of the body 40 of the igniter 10 is configured for mounting the igniter 10 in an installed position in the engine portion 22 and relative to the combustion chamber 26, for example, by positioning the igniter body 40 in an igniter port 24 defined by the engine portion 22 and configured to receive the igniter 10. In one example, the engine portion 22 may be a cylinder head of the engine 20 at least partially defining a combustion chamber surface 28 and combustion chamber 26 of the engine 20. The igniter 10 may be sized such that the igniter 10 can be installed to a standard sized igniter port 24 of an engine 20, where the igniter port 24 may also be commonly known as a spark plug port. In one example, the port end 52 of the igniter 10 may be generally cylindrical and have an igniter outer diameter 42 (see FIGS.

Figure 5:
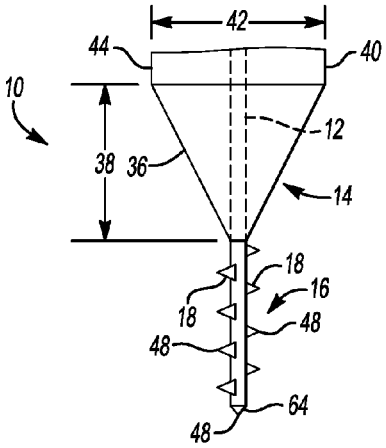
FIG. 5 is a schematic side view of a third example configuration of a plasma igniter.
Figure 6:
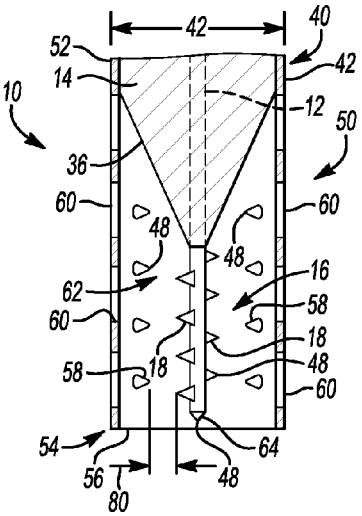
FIG. 6 is a schematic cross-sectional view of a fourth example configuration of a plasma igniter.
Figure 7:
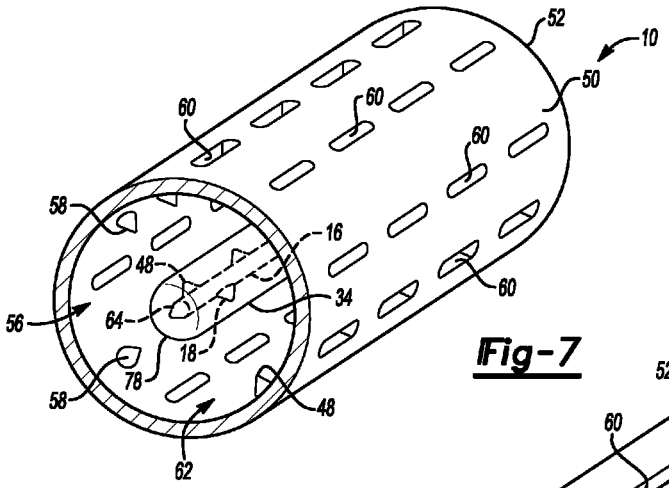
FIG. 7 is a perspective view of the plasma igniter of FIG. 3.

5 and 6) of 14 mm nominally, such that the igniter 10 may be installed to a standard sized igniter port 24. The port end 52 of the igniter 10 includes a port interface 44 configured to interface with the igniter port 24 to retain the igniter 10 in an installed position in the engine 20. In one example, the port interface 44 may be a threaded interface, such that the igniter 10 described herein may be configured as a screw-in replacement installable into a standard threaded spark plug port of an engine 20. The igniter outer diameter 42 and igniter port 24 interface may be defined by the igniter body 40 as shown in FIG. 5 or by a ground electrode 50 of the igniter 10 as shown in FIG. 6. The example provided herein is not limiting, and other configurations of the port interface 44 and/or other sizes of the igniter 10 described herein are possible. For example, the igniter 10 may have an outer diameter of less than 14 mm, such that the igniter 10 is more compact than a standard sized spark plug or igniter 10 and requires less packaging space in an engine 20 as compared with a standard sized spark plug. In this event, the igniter 10 may be installed into a standard sized port by use of an adapter or sleeve (not shown), which may be a generally cylindrical sleeve having an outer surface configured to screw into a standard spark plug port 24 and an inner surface configured to interface with the igniter port 24 interface to retain the igniter 10 in an installed position in the engine 20. By way of example, the igniter 10 may have an outer diameter which is one of 10 mm, 12 mm, or 14 mm. Other sizes are possible, including sizes smaller than 10 mm or larger than 14 mm.

In the installed position in the engine 20, as shown in FIGS. 1 and 3, the body 40 of the igniter 10 is retained in the engine portion 22 such that the shank portion 36 and firing portions 16 of the igniter 10 extend into the combustion chamber 26, and such that the firing portion 16 is separated from the combustion chamber surface 28 by the shank portion 36. In the example shown, the shank portion 36 may be characterized by a shank length 38 which provides a minimum clearance or distance between the firing portion 16 of the power electrode 12 and the combustion chamber surface 28. In the example shown, the body 40 including the shank portion 36 may be made of an insulating material to prevent direct electrical contact between the power electrode 12 and an electrical ground. In the example shown in FIG. 1, one or more of the combustion chamber surface 28, a piston (not shown) disposed in the combustion chamber 26 below the igniter 10, or other surface (not shown) of the engine 20 forming the combustion chamber 26 may act as an electrical ground. In the examples shown in FIGS. 3-4 and 6-9, the igniter 10 includes a ground electrode 50, which in the non-limiting examples shown is a generally cylindrical electrode operatively attached to the body 40 of the igniter 10 such that the ground electrode 50 is coaxial with the power electrode 12 and defines a discharge cavity 62 between the ground electrode 50 and the firing portion 16 of the power electrode 12.

The power electrode 12, which may also be referred to herein as the central electrode 12, includes tiered firing prongs 18 distributed axially along the firing portion 16 of the central electrode 12. Each tier 70 (see FIGS. 10 and 12) of firing prongs 18 includes at least one firing prong 18 extending radially from the central electrode 12 and terminating at a prong tip 48. The firing prong 18 is shaped such that cross-sectional area of the prong tip 48 is smaller relative to the remainder of the firing prong 18, and such that when a high frequency voltage is applied to the central electrode 12 an electric field formed at each firing prong 18 is concentrated at the prong tip 48 of the respective firing prong 18. In the examples shown in FIGS. 1-13, the firing prong 18 is generally conical in shape, with the prong tip 48 defined by the apex of the conical shape. In another example shown in FIGS. 14-15, the firing prong 18 is shaped as a generally triangular blade terminating in a prong tip 48 defined by the apex of the triangle. The examples shown are not limiting, and other configurations of the firing prong 18 and prong tip 48 may be used, where the prong tip 48 is characterized by a cross-sectional area relatively smaller than a cross-sectional area of the firing prong 18 where the firing prong 18 attaches to the central electrode 12, e.g., relative to a base of the firing prong 18. For example, the firing prong 18 may have another shape which tapers or narrows as it extends radially from the central electrode 12. In one example, the firing prong 18 may be shaped as a tapered blade such that the blade edge defines the prong tip 48. In one example, the tiers 70 of firing prongs 18 may be defined by a thread form (not shown) formed on the central electrode 12, where the peak of the thread form defines the prong tip 48. The thread form defining the tiered firing prongs 18 may be a fluted or interrupted thread form. The firing portion 16 terminates at an electrode end 64, which terminates in a prong tip 48. In the non-limiting example shown, the shapes of the electrode end 64 and the firing prongs 18 are each conical, and it would be understood that the shape of the electrode end 64 may differ from the shape of the firing prong 18. The central electrode 12 and firing prongs 18 are made of a highly conductive material able to withstand the high temperatures and pressures of an engine 20 environment. For example, the central electrode 12 and firing prongs 18 may be made of a refractory metal and/or alloys of refractory metals. In a non-limiting example, the central electrode 12 and/or firing prongs 18 may be made of a tungsten-containing material and/or an iridium-containing material.

Figure 9:
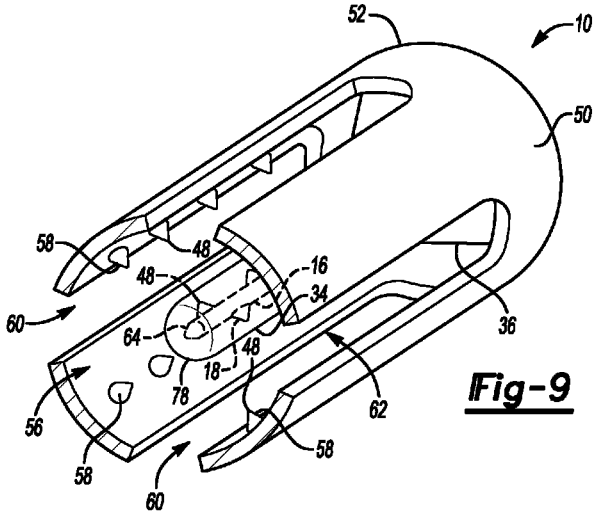
FIG. 9 is a perspective view of the plasma igniter of FIG. 7 showing a third example configuration of a ground electrode.
Figure 10:
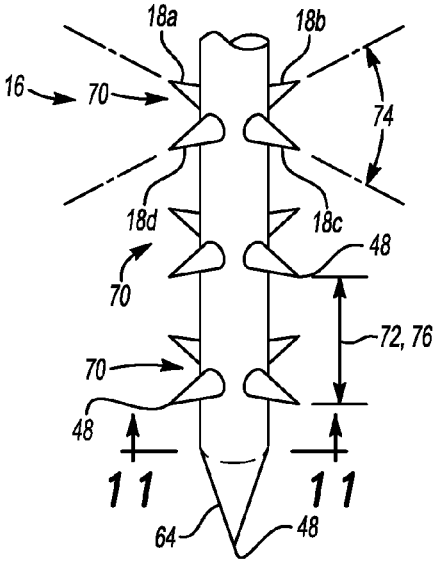
FIG. 10 is a perspective side view of an example configuration of a power electrode of a plasma igniter.
Figure 11:
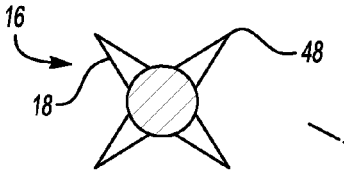
FIG. 11 is a schematic cross-sectional view of the power electrode of FIG. 10.

In the example shown in FIGS. 1-15, the firing prongs 18 are distributed in tiers 70 such that the firing prongs 18 and the prong tiers 70 are spaced axially along the longitudinal length of the firing portion 16 of the central electrode 12, and the firing prongs 18 are distributed or spaced radially relative to the central electrode 12. As defined herein, a "prong tier" 70 includes those firing prongs 18 which are co-planar in a plane perpendicular to the longitudinal axis of the central electrode 12. For example, and referring to FIGS. 10 and 11, the firing portion 16 shown includes three tiers 70 of firing prongs 18 distributed axially such that each tier 70 is separated from an adjacent tier 70 by a tier spacing 76, shown as an axial length. In the example shown in FIG. 10, each tier 70 includes four firing prongs 18*a*, 18*b*, 18*c*, 18*d* which are distributed radially within the plane of the tier 70, where each firing prong 18 in the tier 70 is spaced relative to an adjacent firing prong 18 in the tier 70 by a radial spacing 74, which in the example shown is 90 degrees. FIGS. 10 and 11 show the tiers 70 are radially aligned to each other such that each firing prong 18 in a prong tier 70 is spaced longitudinally from a respective firing prong 18 in an adjacent tier 70 at a prong axial spacing 72, shown as an axial length. As shown in FIG. 10, with the prong tiers 70 radially aligned, the tier spacing 76 and the prong axial spacing 72 are the same.

Figure 12:
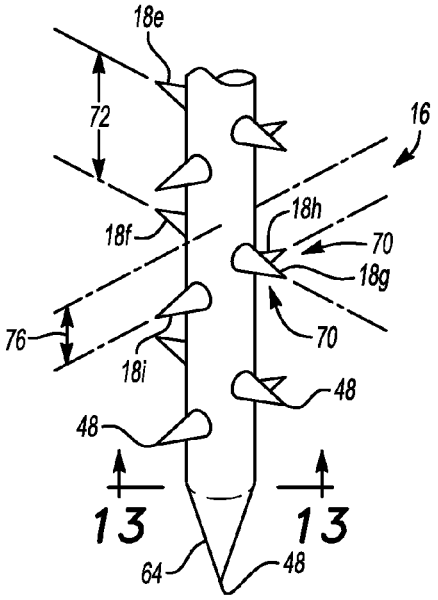
FIG. 12 is a perspective side view of another example configuration of a power electrode of a plasma igniter.
Figure 13:
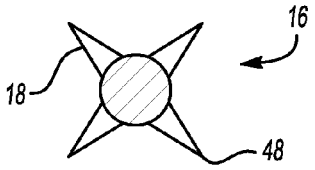
FIG. 13 is a schematic cross-sectional view of the power electrode of FIG. 12.

Referring now to FIGS. 12 and 13, another example configuration of the firing portion 16 is shown, including six tiers 70 of firing prongs 18 distributed axially such that each tier 70 includes two firing prongs 18 and each tier 70 is rotated radially 90 degrees from the adjacent tier 70. In the example shown, one tier 70 includes firing prongs 18*f*, 18*g* which are co-planar and opposing, such that a prong radial spacing of 180 degrees separates firing prong 18*f* from firing prong 18*g*. The one tier 70 including firing prongs 18*f*, 18*g* is adjacent another tier 70 including a pair of firing prongs 18*i*, 18*h*. The adjacent tiers 70 are radially rotated 90 degrees from each other such that the tier spacing 76 is defined by an axial length between the respective planes of the respective adjacent tiers 70, and the prong axial spacing is defined between prongs 18, 48 in alternating tiers 70, e.g., the prong axial spacing 72 is defined in the example shown in FIG. 12 as the axial length between longitudinally aligned firing prongs 18*e*, 18*f*, and such that in the example shown in FIG. 12, the prong axial spacing 72 differs from the prong tier spacing 76.

Figure 14:
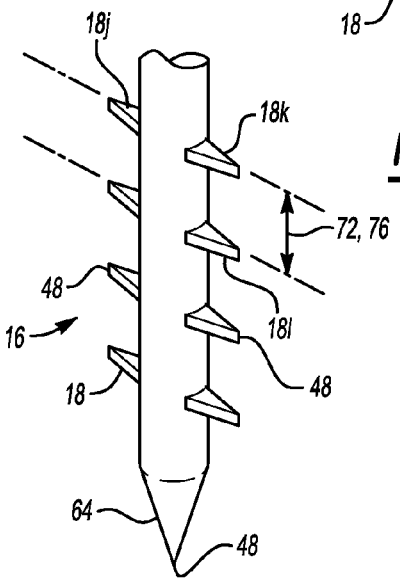
FIG. 14 is a perspective side view of yet another example configuration of a power electrode of a plasma igniter.
Figure 15:
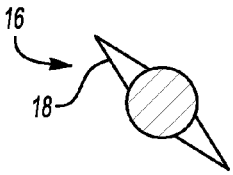
FIG. 15 is a schematic cross-sectional view of the power electrode of FIG. 14.

In another example shown in FIGS. 14 and 15, the firing portion 16 includes four tiers 70 of firing prongs 18 distributed axially such that each tier 70 includes a pair of firing prongs 18 and each tier 70 is radially aligned with each adjacent tier 70. In the example shown, one tier 70 includes firing prongs 18*j*, 18*k* which are co-planar and opposing such that a prong radial spacing 74 of 180 degrees separates firing prong 18*j* from firing prong 18*k*. With the respective firing prongs 18 of the respective tiers 70 radially aligned as shown in FIG. 14, the tier spacing 76 and the prong axial spacing 72 is the same, as shown by the relationship between firing prongs 18*k*, 18*l*.

Referring again to FIGS. 1-4, in the example shown the firing portion 16 includes ten tiers 70 of firing prongs 18 distributed axially such that each tier 70 includes one firing prong 18, e.g., no two firing prongs 18 are co-planar in a plane orthogonal to the longitudinal axis of the central electrode 12, and each tier 70 is rotated axially 180 degrees from the adjacent tier 70, such that a firing prong 18 in one tier 70 is opposing, e.g., extending in an opposite direction, from the firing prong 18 in an adjacent tier 70, and the firing prongs 18 in alternating tiers 70 are radially aligned to define a prong axial spacing 72 therebetween. With the adjacent tiers 70 radially rotated 180 degrees from each other such that the tier spacing 76 is defined by an axial length between the planes of the respective adjacent tiers 70, in the example shown in FIGS. 1-4, the prong axial spacing 72 differs from and is greater than the prong tier spacing 76.

In operation, a high frequency voltage is applied to the central electrode 12 such that an electric field forms at each firing prong 18 and is concentrated at the tip 48 of the respective firing prong 18. In one example, the frequency of the voltage is in the range of megahertz (MHz) and the voltage in the range of 20-60 kilovolts (kV). The voltage is pulsed such that the electric field concentrated in each of the firing prongs 18 ionizes the combustible air-fuel mixture proximate the tip 48 of each respective firing prong 18 to form a plasma discharge which ignites the combustible mixture. The plasma discharge may be in the form of a plasma discharge streamer (not shown), also referred to herein as a streamer, which originates at the prong tip 48 of the firing prong 18. Streamers are generated by each firing prong 18 of each prong tier 70 of the firing portion 16, such that the plurality of firing prongs 18 generates a plurality of streamers in multiple radial directions and at over the longitudinal length of the firing portion 16 of the central electrode 12, to ignite a larger volume of the combustible mixture, thereby increasing flame development and fuel burn in the combustion chamber 26 relative to ignition devices 10 without firing prongs 18 and/or with a single tier 70 of firing prongs 18. As shown in FIGS. 1-15, the firing prongs 18 are arranged in tiers 70 and are spaced axially and radially relative to the firing portion 16 of the central electrode 12 such that the streamers originating from each prong tip 48 of each firing prong 18 generate a large discharge volume.

Figure 2:
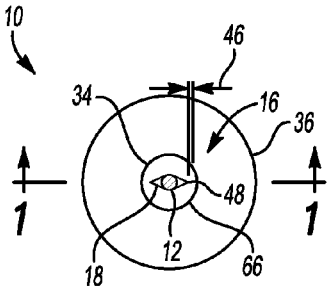
FIG. 2 is a schematic end view of the plasma igniter of FIG. 1.

In a non-limiting example shown in FIGS. 1-4 and 7-9, the firing portion 16 of the central electrode 12 is fully encapsulated by a dielectric casing 34 which provides a dielectric barrier around the firing portion 16 of the central electrode 12 including the tiered firing prongs 18. In one example, the dielectric casing 34 may be integral with the shank portion 36 of the body 40 and the shank portion 36 may be made of the dielectric material 14, such that the length of the central electrode 12 extending into the combustion chamber 26 in an installed position is fully encapsulated by the dielectric material 14. The casing 34 is configured such that the dielectric barrier is of variable thickness, such that the electric field accumulated in the dielectric barrier of the casing 34 is variable with the thickness of the casing 34. As shown in FIG. 1, the casing 34 defines a casing surface 66 which is generally cylindrical and coaxial with the central electrode 12 such that the casing 34 is relatively thicker in the axial length between the firing prongs 18, and decreases in thickness between the casing surface 66 and the firing prong 18 as the firing prong 18 tapers to the prong tip 48, such that the dielectric casing 34 is thinnest at the prong tip 48 of each firing prong 18, as shown in FIG. 2, where at its thinnest portion the dielectric casing 34 forms a dielectric barrier having a barrier thickness 46. By way of example, the dielectric casing 34 may be configured such that at the prong tip 48 of the firing prong 18 the barrier thickness 46 between the prong tip 48 and the casing surface 66 is in the range of 0.5 mm-2 mm. By way of example, the generally cylindrical casing 34 may have a casing diameter 68 (see FIG. 4) in the range of 5 mm-8 mm. The casing 34 terminates at a casing end 78 which encapsulates the electrode end 64. The casing end 78 shown in FIGS. 1, 3 and 7-9 is shaped as a hemisphere. This example is non-limiting, and the casing end 78 may be otherwise shaped and/or contoured relative to the contour of the electrode end 64, to provide a relative thinner casing thickness 46 between the prong tip 48 of the electrode end 64 and the casing surface 66. The casing end 78 may be shaped, for example, as a conical end, a cylindrical end, a chamfered cylindrical end, etc. The dielectric material 14 may be any dielectric material 14 able to withstand the high temperatures and pressures of an engine 20 environment. For example, the dielectric material 14 may be a glass, quartz, or ceramic dielectric material 14, such as a high purity alumina.

In operation, as described previously, a high frequency voltage is applied to the central electrode 12, generating a highly concentrated electric field at the prong tip 48 of each firing prong 18. The electric field ionizes the air-fuel mixture proximate the prong tip 48 of each firing prong 18, forming plasma discharge streamers at each prong tip 48. The formation of the streamers is affected by the dielectric casing 34 such that the barrier discharge at the dielectric casing 34 forming a dielectric barrier over the firing prong 18 causes the continuous formation, discharge and reformation of the streamers at the tips 48 of each of the firing prongs 18 during application of high voltage to the central electrode 12, and such that the discharge streamers formed in this manner are self-propagating and continuously forming at the tip 48 of each firing prong 18, and are self-extinguishing due to charge trapping occurring at the dielectric barrier formed by the casing 34, such that the discharge streamers so formed self-extinguish prior to arcing. The plasma discharge streamers ignite the combustible air-fuel mixture in a large discharge area formed proximate the firing portion 16 of the igniter 10, causing flame development and fuel burn in the combustion chamber 26.

The frequency, magnitude and duration of the applied voltage may be controlled by the controller 30 to affect the timing, intensity and duration of streamer formation. The voltage applied to the power electrode 12 may be a high frequency voltage in the range of MHz applied as a high voltage electrical pulse. Because the streamers formed by the combination of the firing prongs 18 and the dielectric barrier are self-propagating and self-extinguishing such that arc formation is prevented, control of the streamer formation is less sensitive to voltage, frequency, and duration control. Further, because multiple streamers are formed at each prong tier 70 of the multi-tier firing portion 16, the effective discharge volume is formed as defined by the arrangement of the plurality of firing prongs 18 distributed along the firing portion 16 of the central electrode 12, where the effective discharge volume is substantially larger relative to a discharge volume produced by a conventional corona ignition system or a conventional barrier discharge igniter 10. The larger discharge volume and the self-propagating and self-extinguishing characteristics of the discharge streamers contribute to relatively longer device lifetime, improved fuel economy, combustion stability and lower emissions. For example, the formation of multiple streamer formations at each firing prong 18 of the firing portion 16 as the result of the highly concentrated electric fields formed at each firing prong 18 increases the radical yield formed in the plasma discharge, thus enhancing fuel reactivity and fuel burn efficiency, reducing emissions. The multiple streamers produced at each firing prong 18 provide a large discharge area for effective flame development in stoichiometric homogeneous, lean homogeneous, rich homogeneous, and/or lean/rich stratified and lean controlled autoignition combustion applications.

Referring again to FIGS. 1 and 2, in the non-limiting example shown the port end 52 of the body 40 of the igniter 10 is retained in the engine portion 22 such that the shank portion 36 and firing portions 16 of the igniter 10 extend into the combustion chamber 26, and such that the firing portion 16 is separated from the combustion chamber surface 28 by the shank portion 36. In the example shown, the shank portion 36 may be characterized by a shank length 38 which provides a minimum clearance or distance between the firing portion 16 of the power electrode 12 and the combustion chamber surface 28. The body 40 including the shank portion 36 may be made of an insulating material. The firing portion 16 of the igniter 10 is fully encapsulated by a dielectric casing 34, such that the body 40 including the shank portion 36 in combination with the integral casing 34 fully encapsulate the central electrode 12 to prevent direct electrical contact between the power electrode 12 and an electrical ground. In the example shown in FIG. 1, one or more of the combustion chamber surface 28, a piston (not shown) disposed in the combustion chamber 26 below the igniter 10, or other surface (not shown) of the engine 20 forming the combustion chamber 26 may act as an electrical ground. In operation, a high frequency high voltage pulse is applied to the central electrode 12 from the power source 32 such that electric fields are formed in each of the plurality of firing prongs 18 distributed in multiple tiers 70 in the firing portion 16 of the central electrode 12. The electric fields are concentrated at the prong tips 48 of each of the firing prongs 18, and as described previously, ionize the combustible mixture proximate the casing surface 66 forming a dielectric barrier 14 between the firing prongs 18 and the ground surfaces proximate the igniter 10, which may include the combustion chamber surface 28, a piston surface (not shown), etc. The ionized combustible mixture forms a plurality of plasma discharge streamers originating by the tips 48 of the multiple firing prongs 18, which travel radially outward from the firing portion 16 of the igniter 10 and toward the ground surfaces to ignite the air-fuel mixture. As described previously, the dynamic electric field generated by the dielectric barrier 14 defined by the casing 34 continuously discharges the multiple streamers to both self-propagate and to self-extinguish prior to forming an arc.

In another example shown in FIG. 5, the igniter 10 may be configured similar to the igniter 10 shown in FIG. 1, however without the dielectric casing 34, such that the firing portion 16 of the central electrode 12 is exposed directly to the combustion chamber 26. The shank portion 36 is made of an insulating material, which may be a dielectric material, and has a sufficient shank length 38 such that the firing portion 16 is separated from the ground surface provided by the combustion chamber surface 28 to prevent and/or substantially minimize electrical contact between the firing portion 16 of the central electrode 12 and the combustion chamber surface 28, and to prevent arcing of the streamers to the combustion chamber surface 28. In this configuration and as described previously, a high frequency, high voltage pulse is applied to the central electrode 12 such that electric fields are formed in each of the firing prongs 18, and concentrated in the prong tip 48 of the firing prongs 18, to ionize the combustible mixture in the combustion chamber 26 near each of the prong tips 48. The ionized combustible mixture forms plasma discharge streamers originating by the prong tips 48 and extending toward the ground surfaces defined, for example, by the proximate combustion chamber surface 28 and/or a piston surface, which ignite the air-fuel mixture causing flame development and subsequent fuel burn. The controller 30 controls the frequency, magnitude and pulse of the voltage pulse to prevent arcing. The large ionized volume and the large streamer volume produced by the multiple firing prongs 18 distributed radially and axially in tiers 70 relative to the longitudinal axis of the firing portion 16 increases the ignition and burn efficiency as well as produces a relatively higher radical yield to enhance fuel reactivity.

In the examples shown in FIGS. 3-4 and 6-9, the igniter 10 includes a ground electrode 50, which in the non-limiting examples shown is a generally cylindrical electrode operatively attached to the body 40 of the igniter 10 such that the ground electrode 50 is coaxial with the power electrode 12 and defines a discharge cavity 62 between the ground electrode 50 and the firing portion 16 of the power electrode 12. The ground electrode 50 is made of an electrically conductive material able to withstand the high temperatures and high pressures of the combustion chamber 26 environment. In one example, the ground electrode 50 may be made of a refractory metal and/or alloys of refractory metals. In a non-limiting example, the ground electrode 50 may be made of a tungsten-containing material and/or an iridium-containing material.

Figure 4:
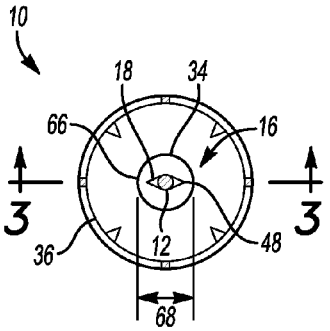
FIG. 4 is a schematic end view of the plasma igniter of FIG. 3.

In the examples shown, the ground electrode 50 includes a plurality of ground prongs 58 distributed longitudinally along and extending radially from the interior surface of the generally cylindrical ground electrode 50 toward the firing portion 16, e.g., extending radially inward into the discharge cavity 62. A discharge gap 80 is defined between closest adjacent surfaces of the ground electrode 50 and the central electrode 12. In the example shown in FIG. 3, the discharge gap 80 is defined by the gap between the prong tips 48 of the ground prongs 58 and the casing surface 66. In the example shown in FIG. 6, the discharge gap 80 is defined by the gap between the prong tips 48 of the ground prongs 58 of the ground electrode 50 and the prong tips 48 of the firing prongs 18 of the central electrode 12. The ground prongs 58 are distributed and positioned relative to the firing prongs 18 such that there are multiple streamers forming between the firing prongs 18 and the ground prongs 58 in the discharge cavity 62. For example, and as shown in FIG. 4, the firing portion 16 of the central electrode 12 is oriented relative to the ground prongs 58 of the ground electrode 50 such that each firing prong 18, in the cross-section shown, is proximate a respective pair of ground prongs 58, such that streamer formation occurs between each firing prong 18 and each of the ground prongs 58 of the respective pair of ground prongs 58 adjacent the firing prong 18, to generate multiple streamers which may or may not cross each other, yet are distributed radially throughout the discharge cavity 62.

For example and as shown in FIG. 3, the ground electrode 50 is attached to and surrounds the igniter body 40 at the port end 52 of the igniter 10 such that the ground electrode 50 defines the port interface 44, and such that in the installed position the ground electrode 50 is in contact with the igniter port 24 of the engine portion 22. In one example, the outwardly facing surface of the ground electrode 50 at the port end 52 may be threaded (not shown) to interface with a threaded portion (not shown) of the igniter port 24, such that the igniter 10 may be threaded into the igniter port 24 in an installed position.

The ground electrode 50 is open at the igniter 10 end, defining an orifice 56 to allow for flow of the air-fuel combustible mixture from the combustion chamber 26 into the discharge cavity 62 of the ground electrode 50. The ground electrode 50 further includes a plurality of apertures 60 formed in the cylindrical portion of the ground electrode 50 adjacent the firing portion 16. The plurality of apertures 60 are distributed longitudinally and radially in the longitudinal length of the ground electrode 50 adjacent the firing portion 16 to allow for additional flow of the air-fuel combustible mixture from the combustion chamber 26 into the discharge cavity 62 of the ground electrode 50 along the longitudinal length of the firing portion 16. The orifice 56 and the plurality of apertures 60 each define an ignition path from the discharge cavity 62 to the combustion chamber 26, such that multiple ignition paths are provided radially and axially along the entire longitudinal length the igniter 10 extends into the combustion chamber 26. The plurality of apertures 60 may be characterized as a plurality of flame ports such that flame development and fuel burn is distributed radially and axially from the full length of the firing portion 16, increasing fuel burn efficiency by igniting the air-fuel mixture in the combustion chamber 26 at each of the multiple flame ports and in a volume extending radially and axially from the outwardly facing surface of the ground electrode 50.

In a first example configuration shown in FIGS. 3-7, the plurality of apertures 60 are configured as a plurality of holes or slots 60 which are distributed longitudinally and radially in the longitudinal length of the ground electrode 50 adjacent the firing portion 16. A plurality of ground prongs 58 are distributed longitudinally between the plurality of apertures 60, such that a plurality of discharge paths are established between each firing prong 18 and at least one ground prong 58 along a discharge gap 80 defined between the prong time of the firing prong 18 and the prong tip 48 of the adjacent ground prong 58. In operation, a high frequency/high voltage pulse is applied to the central electrode 12, and as described previously, electric fields become concentrated at the prong tips 48 of the firing prongs 18 and ionize the air-fuel mixture in the discharge cavity 62 such that the ionized combustible mixture forms a plurality of plasma discharge streamers originating at the tips 48 of the multiple firing prongs 18, which travel radially outward from the firing portion 16 of the igniter 10 and toward the ground prongs 58 of the ground electrode 50, to ignite the air-fuel mixture in the discharge cavity 62. The apertures 60 operate simultaneously as vents and flame ports to provide air-fuel mixture to the discharge cavity 62 to continue the ionization process while providing a flame path for flame development and ignition of the air-fuel mixture in the combustion chamber 26 outside of the ground electrode 50. Streamer formation in a self-propagating and self-extinguishing cycle continues at the dielectric barrier 14 provided by the casing 34 encapsulating the firing portion 16, such that the ignition process continues without arc formation. The large ionized volume and the large streamer volume produced by the multiple tiers 70 of firing prongs 18 and multiple apertures 60 acting as flame ports distributed radially and axially relative to the longitudinal axis of the firing portion 16 increases the ignition and burn efficiency as well as produces a relatively higher radical yield to enhance fuel reactivity.

In the example shown in FIG. 6, the igniter 10 may be configured similar to the igniter 10 shown in FIG. 3, however without the dielectric casing 34, such that the firing portion 16 of the central electrode 12 is exposed directly to the ground electrode 50. The shank portion 36 is made of an insulating material and has a sufficient shank length 38 such that the firing portion 16 is separated from the portion of the ground electrode 50 adjacent the combustion chamber surface 28 to direct streamer formation toward the firing end 54 of the igniter 10. In this configuration and as described previously, a high frequency, high voltage pulse is applied to the central electrode 12 such that electric fields are formed in each of the firing prongs 18, and concentrated in the prong tip 48 of the firing prongs 18, to ionize the combustible mixture in the discharge cavity 62 near each of the firing prongs 18. The ionized combustible mixture forms plasma discharge streamers originating by the prong tips 48 and extending toward the ground prongs 58 of the ground electrode 50 to ignite the air-fuel mixture causing flame development and subsequent fuel burn. The controller 30 controls the frequency, magnitude and pulse of the voltage pulse to prevent arcing in this configuration.

Figure 8:
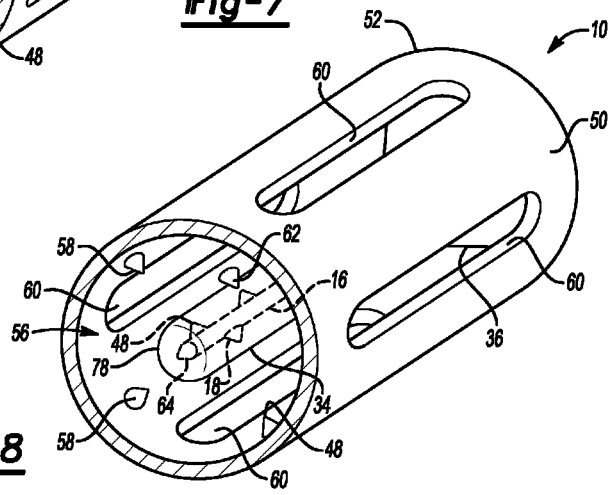
FIG. 8 is a perspective view of the plasma igniter of FIG. 7 showing a second example configuration of a ground electrode.

In a non-limiting example, another configuration of the ground electrode 50 is shown in FIG. 8, which includes a plurality of slots 60 arranged radially and extending the longitudinal length of the firing portion 16, to provide venting of the air-fuel mixture into the discharge, venting of ionized material from the discharge cavity 62 to increase fuel reactivity, and to act as flame ports to extend ignition to the air-fuel mixture in the combustion chamber 26 proximate the igniter 10. Ground prongs 58 may be distributed on the interior surfaces of the ground electrode 50 between the apertures 60. In another non-limiting example shown in FIG. 9, the apertures 60 may be configured as slots extending from the firing end 54 of the ground electrode 50 from the ground electrode orifice 56, and extending longitudinally, for example, the length of the firing portion 16 of the central electrode 12. A plurality of ground prongs 58 are located between the apertures 60 and extend radially inward, as shown in FIG. 9.

In the examples shown in FIGS. 3-9, the ground prongs 58 may be generally conical in shape and define a prong tip 48, similar to the shape of the firing prongs 18. The examples are non-limiting, and other configurations of the ground prongs 58 may be used, where the prong tip 48 of the ground prong 58 is characterized by a cross-sectional area relatively smaller than a cross-sectional area of the ground prong 58 where the ground prong 58 attaches to the interior surface of the ground electrode 50. For example, the ground prong 58 may have another shape which tapers or narrows as it extends radially from the central electrode 12 toward the firing portion 18. In one example, the ground prong 58 may be shaped as a tapered blade such that the blade edge defines the prong tip 48. The number, pattern and/or distribution of the ground prongs 58 may be varied from the examples shown in FIGS. 3-9, such that the ground prongs 58 are arranged to generate a pattern of streamer formation distributed radially and axially through the discharge cavity 62. The location and/or distribution of the ground prongs 58 relative to the apertures 60 and/or the orifice 56 may be varied to generate a pattern of streamer formation to enhance flame development and fuel burn via the apertures 60 acting as flame ports, and/or the orifice 56.

It would be understood that modifications and variations of the present invention are possible in light of the above teachings and may be practiced otherwise than as specifically described while within the scope of the appended claims. In addition, the reference numerals in the claims are merely for convenience and are not to be read in any way as limiting. The examples provided herein are non-limiting, and it would be understood that other configurations and combinations of elements could be used to provide a low-temperature plasma igniter 10 as described herein. For example, the igniter 10 shown in FIGS. 1-9 may be configured to include one of the central electrode 12 configurations shown in FIGS. 10-15, or another arrangement of firing prongs 18 on the firing portion 16 not shown. For example, other tiered arrangements of firing prongs 18 on the firing portion 16 could be used, including two or more prong tiers 70, each tier 70 having at least one firing prong 18, the firing prongs 18 on each tier 70 being regularly or irregularly distributed radially in each prong tier 70, etc. to generate a discharge volume and/or pattern or distribution of streamers corresponding to the particular arrangement and configuration of the firing prongs 18 on the subject firing prongs 18. Likewise, other configurations of the ground electrode 50 may be used, including ground electrodes 50 defining other configurations of apertures 60, vents, slots 60 and orifices 56, other arrangements of ground prongs 58, etc. to facilitate flow of the combustible material proximate the firing portion 16, define a discharge cavity 62 having a particular discharge gap 80, cavity volume, etc., define an aperture 60 arrangement and/or orifice 56 shape corresponding to an ignition path or flame development pattern to be generated by the igniter 10, etc. The shapes of the firing prongs 18, ground prongs 58, and prong tips 48 may be varied as previously described herein, and the shapes of these may be used in combination, for example, such that the firing prongs 18 and the ground prongs 58 of an igniter 10 are differently shaped, the firing prongs 18 comprise a combination of shapes, for example, such that the shape of the firing prongs 18 differs from one tier 70 to another tier 70 or within a tier 70, etc.

The detailed description and the drawings or figures are supportive and descriptive of the disclosure, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. An igniter comprising:

a central electrode extending longitudinally along a center axis and terminating in a firing portion;

the firing portion including a plurality of prong tiers distributed axially on the firing portion;

each prong tier including at least one firing prong extending radially outward from the firing portion;

an igniter body including a port end and a shank; and wherein the central electrode extends longitudinally along a center axis of the body such that the firing portion of the central electrode extends from the shank opposing the port end.

2. The igniter of claim 1, further comprising:

a dielectric casing fully encapsulating the firing portion of the central electrode;

wherein the shank is made of an insulating material and the dielectric casing is integral with the shank.

3. The igniter of claim 2, wherein the dielectric casing encapsulates the at least one firing prong of each of the plurality of prong tiers, to define a dielectric barrier adjacent the firing prong.

4. The igniter of claim 1, further including:

each firing prong defining a firing tip at the outermost radial end of the firing prong.

5. The igniter of claim 4, wherein:

the firing prong has a generally conical shape terminating in an apex; and the firing tip is defined by the apex.

6. The igniter of claim 4, wherein:

the firing prong is shaped as a triangular blade defining an apex; and the firing tip is defined by the apex.

7. The igniter of claim 1, wherein the central electrode is in communication with a power source to receive a high frequency, high voltage pulse from the power source.

8. The igniter of claim 1, wherein the plurality of prong tiers includes:

a first prong tier including a first firing prong; and a second prong tier including a second firing prong;

wherein the first prong tier is axially adjacent to the second prong tier.

9. The igniter of claim 8, wherein the first firing prong is radially aligned with the second firing prong.

10. The igniter of claim 8, wherein the first firing prong is radially offset from the second firing prong.

11. The igniter of claim 1, wherein the plurality of prong tiers includes a first prong tier, a second prong tier, and at least a third prong tier.

12. The igniter of claim 1, wherein the at least one firing prong includes a first firing prong, a second firing prong, and at least a third firing prong.

13. The igniter of claim 1, further comprising:

a generally cylindrical ground electrode defining a discharge cavity surrounding the central electrode.

14. The igniter of claim 13, further comprising:

a plurality of ground prongs defined by the ground electrode and extending radially toward the firing portion.

15. The igniter of claim 14, further comprising:

a plurality of apertures defined by the ground electrode in fluid communication with the discharge cavity.

16. The igniter of claim 15, wherein the plurality of ground prongs are distributed longitudinally between the plurality of apertures.

17. A method comprising:

applying, via a power source, a voltage to a central electrode of an igniter;

wherein the igniter comprises:

a central electrode extending longitudinally along a center axis and terminating in a firing portion;

the firing portion including a plurality of prong tiers distributed axially on the firing portion;

each prong tier including at least one firing prong extending radially outward from the firing portion; and an igniter body including a port end and a shank;

wherein the central electrode extends longitudinally along a center axis of the body such that the firing portion of the central electrode extends from the shank opposing the port end; and pulsing the high frequency voltage to generate a plasma discharge streamer originating from the at least one firing prong of at least one prong tier of the plurality of prong tiers.

18. The method of claim 17, wherein the igniter further comprises:

a dielectric casing fully encapsulating the firing portion of the central electrode;

wherein the shank is made of an insulating material and the dielectric casing is integral with the shank; and wherein the dielectric casing encapsulates the at least one firing prong of each of the plurality of prong tiers, to define a dielectric barrier adjacent the firing prong.

19. The method of claim 17, wherein the igniter further comprises:

a ground electrode operatively attached to the igniter body such that the ground electrode is coaxial with the power electrode and defines a discharge cavity between the ground electrode and the firing portion of the central electrode.

20. The method of claim 19, wherein the ground electrode comprises:

a plurality of ground prongs distributed longitudinally along and extending from a surface of the ground electrode into the discharge cavity;

the method further comprising:

forming a plurality of streamers when the voltage is applied to the central electrode;

wherein each respective one of the plurality of streamers is formed between a respective one of the firing prongs and a respective one of the ground prongs.

* * * * *